US009386819B2

(12) United States Patent
Hakkala

(10) Patent No.: US 9,386,819 B2
(45) Date of Patent: Jul. 12, 2016

(54) INSOLE WITH HEATING ELEMENT

(75) Inventor: Erkki Hakkala, Helsinki (FI)

(73) Assignee: FOOTBALANCE SYSTEM OY, Vantaa (FI)

( * ) Notice: Subject to any disclaimer, the term of this patent is extended or adjusted under 35 U.S.C. 154(b) by 292 days.

(21) Appl. No.: 14/130,749

(22) PCT Filed: Jul. 6, 2011

(86) PCT No.: PCT/FI2011/050636

§ 371 (c)(1),
(2), (4) Date: Mar. 12, 2014

(87) PCT Pub. No.: WO2013/004886

PCT Pub. Date: Jan. 10, 2013

(65) Prior Publication Data

US 2014/0182162 A1 Jul. 3, 2014

(51) Int. Cl.

| | |
|---|---|
| ***A43B 7/04*** | (2006.01) |
| ***A43B 7/02*** | (2006.01) |
| ***A43B 3/00*** | (2006.01) |
| ***A43B 17/00*** | (2006.01) |

(52) U.S. Cl.

CPC ..... *A43B 7/02* (2013.01); *A43B 3/0015* (2013.01); *A43B 7/04* (2013.01); *A43B 17/00* (2013.01)

(58) Field of Classification Search

CPC ..... A43B 7/02; A43B 7/025; A43B 7/04
USPC ..... 36/2.6, 43, 44; 12/146 M
See application file for complete search history.

(56) References Cited

U.S. PATENT DOCUMENTS

| | | | | |
|---|---|---|---|---|
| 3,906,185 | A * | 9/1975 | Gross | A43B 3/0005 219/211 |
| 7,418,793 | B2 * | 9/2008 | Dominguez | A43B 3/0031 36/132 |
| 2002/0017035 | A1 * | 2/2002 | Treptow | A43B 7/02 36/2.6 |
| 2002/0133973 | A1 * | 9/2002 | Lin | A43B 7/025 36/2.6 |
| 2004/0020074 | A1 * | 2/2004 | Brait | A43B 5/0405 36/2.6 |
| 2006/0201025 | A1 * | 9/2006 | Chou | A43B 7/04 36/2.6 |
| 2008/0110060 | A1 * | 5/2008 | Ritter | A43B 3/0031 36/136 |
| 2011/0083339 | A1 * | 4/2011 | Luo | A43B 3/0005 36/2.6 |
| 2011/0107771 | A1 | 5/2011 | Crist et al. | |
| 2012/0311885 | A1 * | 12/2012 | Moreshead | H05B 3/347 36/2.6 |
| 2013/0247410 | A1 * | 9/2013 | Tseng | A43B 7/02 36/2.6 |

FOREIGN PATENT DOCUMENTS

| | | | |
|---|---|---|---|
| JP | 62275403 | A | 11/1987 |
| WO | 9814082 | A1 | 4/1998 |
| WO | 2004107817 | A1 | 12/2004 |
| WO | 2008006929 | A1 | 1/2008 |

OTHER PUBLICATIONS

International Search Report, dated Mar. 2012, from corresponding PCT application.

* cited by examiner

*Primary Examiner* — Marie Bays
(74) *Attorney, Agent, or Firm* — Young & Thompson

(57) ABSTRACT

An insole for a shoe includes at least a plate of thermoplastic material and a heating element. The thermoplastic plate is fully customizable. Fully customizable soles for shoes with heating elements, and a method for obtaining insoles or soles, especially for winter shoes are also described.

15 Claims, 4 Drawing Sheets

INSOLE WITH HEATING ELEMENT

FIELD OF THE INVENTION

The present invention generally relates to footwear with heating elements. In particular the invention concerns customizable insoles with heating elements, customizable soles for shoes with heating elements, and a method for obtaining those.

BACKGROUND OF THE INVENTION

Nowadays, popularity of winter sports and outdoor life is growing. Due to an increasing need materials of winter outfits and boots especially for winter conditions are developed. However, in cold environmental conditions especially toes are particularly susceptible to losing body temperature and becoming uncomfortably cold. To provide insulation from cold temperatures special winter shoes, such as snow boots, ski boots, slalom boots, some hiking boots and ice skates, are made especially for wintry conditions. Upper parts of winter shoes are usually made of cloth or leather, soles are made of rubber materials, and shoe insoles and liners include padding, artificial fur, fur and/or other materials.

The insulating properties of regular winter shoe materials helps to keep the toes warm in some circumstances, but in freezing conditions or when one is staying a long period in cold conditions body temperature may begin to fall and the insulation in the regular winter shoe may no longer be adequate. In some circumstances, it is advantageous to provide a heat source within a winter shoe, because once a person's feet become too cold, there is a risk of numbness, frostbite, or even hypothermia.

In addition, most of the people in the world population suffer from some sort of foot problems. Foot motion/gait problems reflect to soles, ankles, knees, hips, back, etc; that is why their treatment and prevention is particularly beneficial to the whole human well-being. The load on feet in winter sports is higher than the weight of the body. For example, while skating the ground force may be about 1.5 to 2 times one's body weight. Different (arch) support insoles are available for correcting the foot position. They have been designed to support longitudinal medial and lateral arch but without separately glued wedges they do not actually correct foot position. Wedging is a time-consuming and expensive process. The obtained result depends on the person doing the task and still tends to be rather inaccurate. As another drawback, after gluing the wedges to the soles one cannot take a new mold without first removing the wedges.

There is, therefore, a need for a solution that provides warming for toes, but also provides a perfect match to one's feet by a customizable insole for a shoe or a shoe for minimizing the load on feet.

SUMMARY OF THE INVENTION

Now there has been invented an insole for a shoe, which insole comprises a fully customizable thermoplastic material plate and a heating element, by which the above problems are alleviated. Various aspects of the invention include an improved insole, sole for a shoe and a method for manufacturing an insole or sole, which are characterized by what is stated in the independent claims. Various embodiments of the invention are disclosed in the dependent claims.

According to a first aspect, there is provided an insole for a shoe, which insole comprises at least a plate of thermoplastic material and a heating element.

According to an example embodiment the thermoplastic material is ABS, PVC, A-PET or PETG. According to an example embodiment, the insole has a heel area and a toe area and the plate covers at least partially the heel area and the heating unit covers at least partially the toe area. According to an example embodiment, the heating element is arranged to be electrically connected to a battery unit by a wire for power supply for warming up the heating element. According to an example embodiment, there is a distance between the plate and the heating element. According to an example embodiment, the insole comprises at least two layers, wherein the first layer is a surface layer and the second layer is formed from the plate and the heating element. According to an example embodiment, said thermoplastic material becomes plastic substantially under 95° C. and above 45° C. According to an example embodiment, said thermoplastic material becomes plastic substantially under 95° C. and above 77° C.

According to a second aspect, there is provided a shoe comprising a sole, which sole comprises at least a plate of thermoplastic material and a heating element.

According to an example embodiment, said thermoplastic material becomes plastic substantially under 95° C. and above 45° C. According to an example embodiment, said thermoplastic material becomes plastic substantially under 95° C. and above 77° C. According to an example embodiment, the thermoplastic material is ABS, PVC, A-PET or PETG. According to an example embodiment, the thermoplastic plate covers at least the heel area of the sole and the heating unit covers at least partially the toe area of the sole. According to an example embodiment, the heating element is arranged to be electrically connected to a battery unit by a wire for power supply for warming up the heating element. According to an example embodiment, there is a distance between the plate and the heating element. According to an example embodiment, the shoe is a skate, ski boot, winter shoe or slalom shoe.

According to a third aspect, there is provided a method for manufacturing an insole for a shoe comprising the steps of: providing a first surface layer of the insole, wherein the first surface layer has a heel area and a toe area; covering at least partially the heel area of the first surface layer with a plate of thermoplastic material, covering at least partially the toe area of the first surface layer with a heating element.

According to an example embodiment, the method further comprises arranging a wire that is connected to the heating element on the other side of the plate than the first surface such that the wire is guided on the plate from the heating element towards the heel area of the first surface layer. According to an example embodiment, the method further comprises covering the first surface layer, the plate, the heating element and the wire by a second surface layer. According to an example embodiment, the thermoplastic material is ABS, PVC, A-PET or PETG.

DESCRIPTION OF THE DRAWINGS

In the following, various embodiments of the invention will be described in more detail with reference to the appended drawings, in which.

DETAILED DESCRIPTION OF THE EMBODIMENTS

In the following, several embodiments of the invention will be described in the context of a customizable i.e. personalizable insole with a heating element for a shoe, a shoe with customizable sole with a heating element and a method of manufacturing the customizable insole with a heating element for a shoe. It is to be noted, however, that the invention is not limited to these. In fact, also the manufacturing method of sole for shoes may take place in a similar manner as manufacturing insoles. In this line of thought, a shoe may be understood to be any kind of footwear, boot or device intended to be worn on foot in cold, but also in cool, conditions. The term insole in this context comprises also soles that are arranged to be fixed to the boots.

Figure 1:
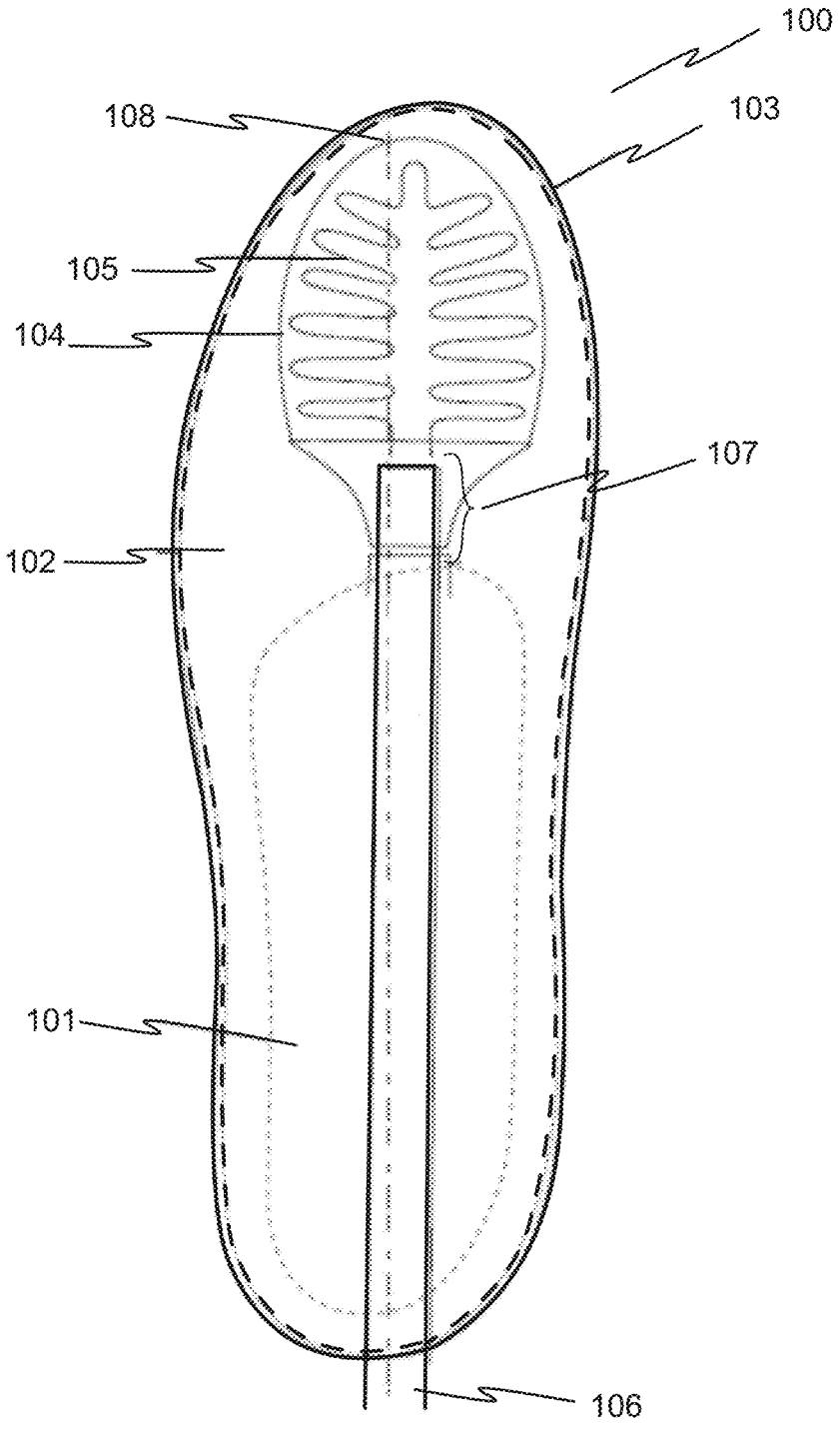
FIG. 1 shows a bottom view of an insole or sole manufactured according to an embodiment of the invention.

FIG. 1 shows a bottom view of an insole according to an embodiment of the invention. The upper layer 102 of the preform insole 100 is placeable against the foot and the lower layer 103 is placeable against the shoe. Materials of these two layers may be selected among any common materials used in insoles. For example, the lower layer 103 may be constructed from a known material such as Rheluflex (trademark of Rhenoflex GmbH Ltd) comprising non-woven polyester as a carrier, ionomerresin-ethylvinylacetate blend as an extruded core, and EVA-Hotmelt as an adhesive.

The insole 100 further comprises at least one fully customizable thermoplastic plate 101, which is made of thermoplastic material and which material is fully customizable by heat. The thermoplastic plate 101 is arranged to cover at least partially the heel area of the insole 100, wherein the heel area comprises the heel and plantar arch area of the target person's foot. The thermoplastic plate 101 does not cover the toe area of the insole 100. However, there could also be, for example, two or three or more thermoplastic plates in the insole 100.

The thermoplastic plate 101 may lay between the upper layer 102 and the lower layer 103. The thermoplastic plate 101 forms a part of the middle layer. However, it is also possible that there is only one surface layer in addition to the thermoplastic plate 101, only the upper layer 102. The used thermoplastic material may be selected from a large group of known thermoplastics. A significant property for the thermoplastic is the temperature, so-called glass transition temperature, where the thermoplastic becomes plastic and on the other hand turns back to solid form when the temperature is decreasing after shaping the insole. The glass transition temperature is typically lower than polymer melting temperature. Therefore, one good temperature range for shaping the preform may be between the glass transition temperature and the melting temperature. A possible temperature for the thermoplastic to become plastic is preferably somewhere under 95° C.and above 45° C. Advantageously the range is from 77° C. to 95° C. The temperature can also be as high as 150° C. Suitable materials that become or are plastic within the preferred ranges are for example thermoplastic polyesters A-PET (Amorphous polyester terephthalate) and PETG (glycol-modified polyethylene terephthalate, which is a copolyester), or such with essentially similar characteristics. Also e.g. ABS (acrylonitrile butadiene styrene), PVC (polyvinyl chloride) can be used. The idea of the thermoplastic plate 101 is to able personalizing of the preform insole 100 by forming the thermoplastic plate of the insole preform based on foot information. The method and apparatus suitable for forming the thermoplastic material is disclosed in PCT/F12009/050890 application.

Thickness of the thermoplastic plate 101 may be selected so as to provide reasonable support to the target person's foot when the layer is in a rigid (solid) state. Other characteristic required for the thermoplastic dictates that it should be rigid under the melting temperature. When warmed, the thermoplastic material will become flexible and therefore a mold with uniform properties (e.g. uniform pressing force) may be used, or a mold with non-uniform properties may be used e.g. to achieve varying thickness. The thermoplastic material may be re-formed, if needed.

Between the upper layer 102 and the lower layer 103 of the insole 100 in the vicinity of the thermoplastic plate 101 there is also a heating unit 104. The heating unit 104 may be a material that is flexible and break-proof. The heating unit 104 comprises a heating element 105 that may be warmed up, for example, by using batteries as a power supply, for warming the toe area, and a wire 106. The heating element 105 may be, for example, continuous stainless steel filament yarn. The heating element 105 may be a part of the same middle layer than the thermoplastic plate 101, but the heating element 105 is arranged to cover at least partially the toe area of the insole 100, wherein the toe area comprises the ball and toe area of the target person's foot. However, the thermoplastic plate 101 and the heating element 105 may also be in a different layer i.e. there may be at least one layer between them.

There may be a distance 107 between the heating element 105 and the thermoplastic plate 101. The distance 107 between the heating element 105 and the thermoplastic plate 101 may be, for example, 1 cm or more. However, it is also possible that the heating element 105 and the thermoplastic plate 101 are next to each other so that there is no distance between them.

The heating element 105 may be electrically connected to the wire 106 that is electrically connectable to a battery unit (not shown). The material of the wire 106 may be flexible and break-proof, for example, a tear-resistant steel-reinforced cable. The wire 106 may extend between the lower layer 103 and the thermoplastic plate 101 and may be guided from the heating element 105 towards the edge of the heel area of the insole 100. The wire 106 may come out from the insole 100 at the heel area so that the wire 106 is suitable to be guided out from a shoe via the back part of the shoe and through the opening of the shoe.

However, in addition to the thermoplastic plate 101 forming a first middle layer with the heating element 105 (if the heating element 105 is in the same layer, they may also be in different layers), there may also be a second middle layer, or even more middle layers than two, for example 3 or 4 between the upper layer 102 and the lower layer 103 and above or under the first middle layer. The first middle layer comprising the thermoplastic plate 101 and the heating element 105 may form the middle layer that only partially covers the area of the upper layer 102 of the insole 100.

Reference number 108 indicates the center line of the perform insole 100.

Figure 2:
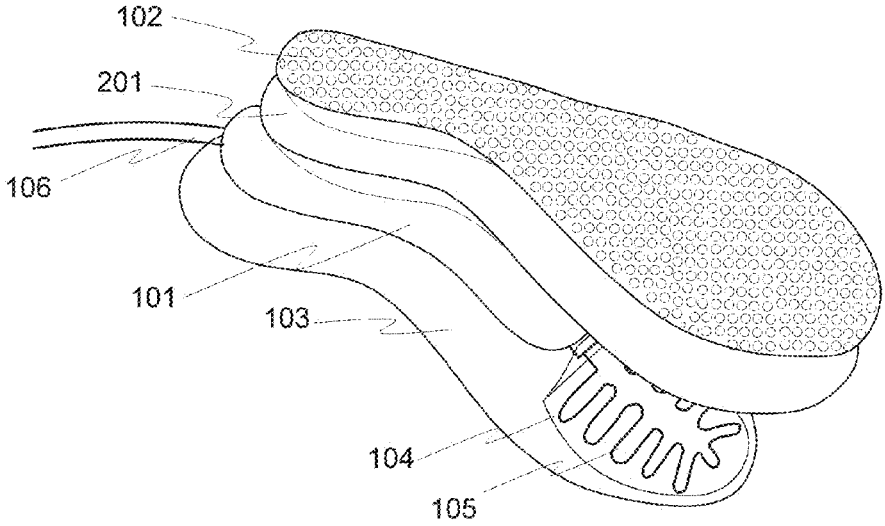
FIG. 2 shows an insole or sole manufactured according to an embodiment of the invention.

With reference to an embodiment shown in FIG. 2, there is disclosed an extra layer 201 between the upper layer 102 and the thermoplastic plate 101 and the heating element 105 for providing comfort. The material of the extra layer 201 may be selected among any common materials used in insoles. The thermoplastic plate 101 made of thermoplastic material covers laterally only a part of the insole 100. The thermoplastic plate 101 extends lengthwise at least under the heel area and in lateral direction advantageously almost to the whole width of the insole 100. Whereas the heating element 105 extends lengthwise at least under the toe area and in lateral direction advantageously almost to the whole width of the insole 100.

The thermoplastic plate 101 may be designed to extend from under the heel to the under the plantar arch of the foot so that transverse arch can be supported. In addition, it is advantageous to keep some range at the edge of the insole without the hard thermoplastic in case there is need for little adjustment when the insole is placed in the shoe. Also, it is a benefit that the toe area of the insole 100 remains without the thermoplastic plate, because absence of thermoplastic material at the toe area may enable natural movement of the foot during walking, running, skiing, skating or doing slalom skiing. However, it is also possible to design the plate larger and the heating element smaller, if needed, for example, it is possible that the heating element covers only the area under the toes. It should also be noted, that if thermoplastic material is used above the heating element 105 i.e. if the thermoplastic plate 101 covers at least partially also the toe area of the insole 100 so that the plate 101 is at least partially on the heating element 105, the heating element 105 may not warm up the toe area enough.

Components of insoles as shown in FIGS. 1 and 2 may also be used for shoes or soles for shoes.

Figure 3A:
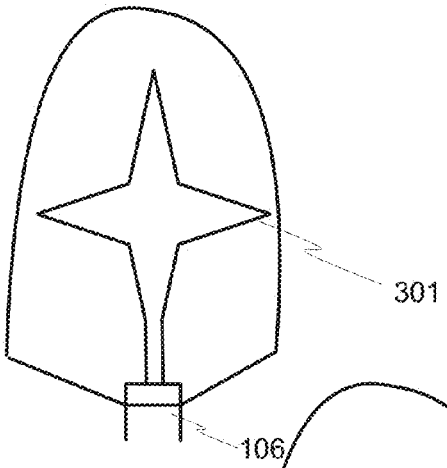
FIG. 3*a* shows a heating element according to an embodiment of the invention.
Figure 3B:
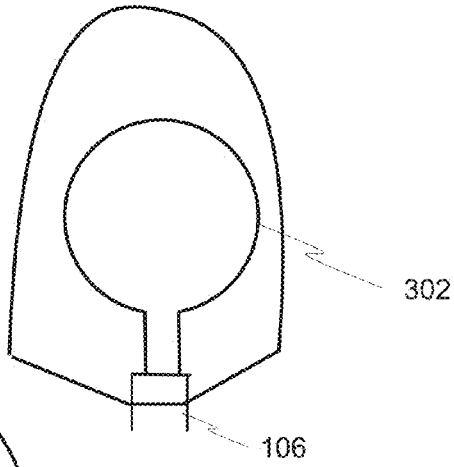
FIG. 3*b* shows a heating element according to an embodiment of the invention.
Figure 3C:
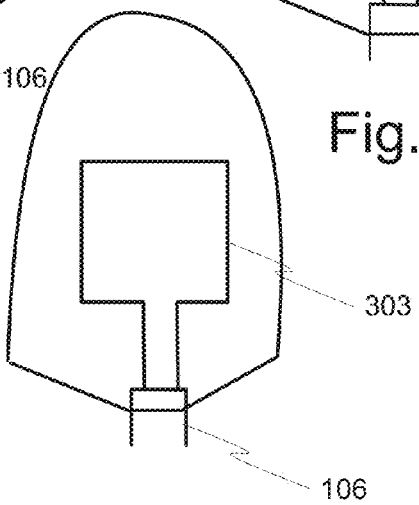
FIG. 3*c* shows a heating element according to an embodiment of the invention.

FIGS. 3*a*, 3*b* and 3*c* show heating elements according to embodiments of the invention. The heating element 301 has a shape of star, the heating element 302 has a shape of circle and the heating element 303 has a shape of rectangle. The shape of heating element is not restricted to any shape, it may have any shape suitable to be warmed.

Figure 4:
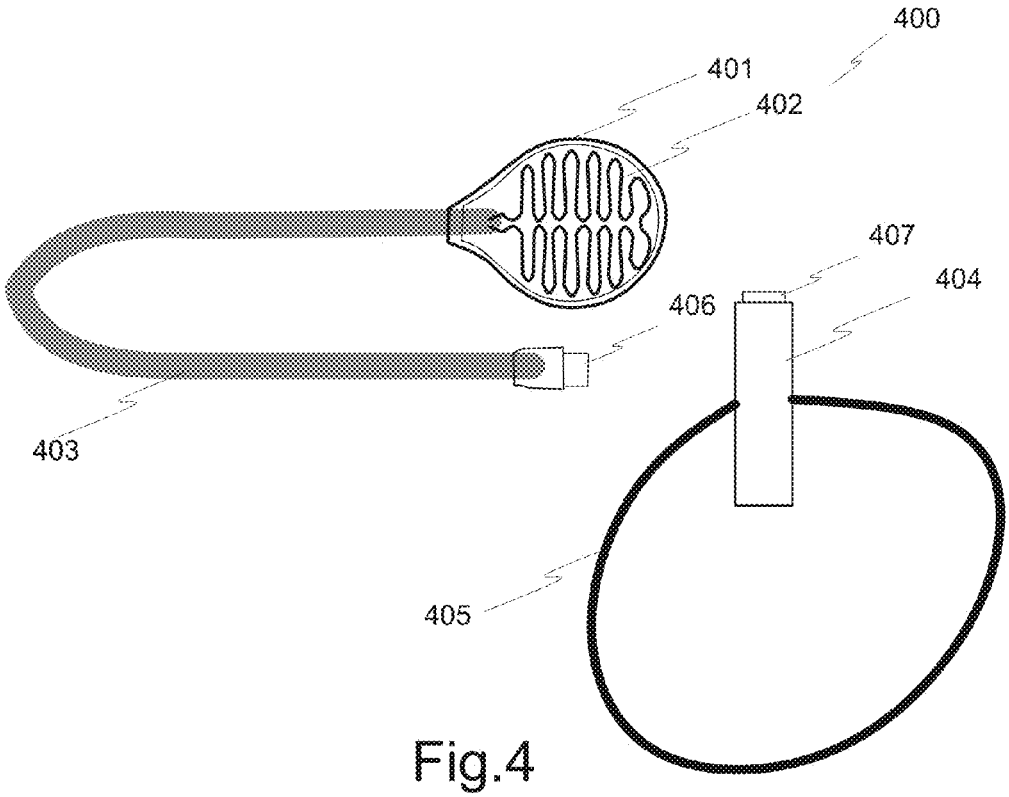
FIG. 4 shows a heating unit and a power supply device for a heating element according to an embodiment of the invention.

FIG. 4 discloses a heating system according to an embodiment of the invention. The heating system 400 comprises at least a heating unit 401 and a battery unit 403. The heating unit 401 comprises a heating element 402 and a wire 403 that is arranged to electrically connect the heating element 402 and the battery unit 404.

The heating element 402 may be battery powered, because battery powering allows it to be portable and lightweight enough to be comfortable. The battery unit 404 may comprise a battery or batteries that are rechargeable, for example, rechargeable nickel-metal hydride batteries with 4.8 voltage and capacity of 1900 mAh or non-rechargeable batteries, for example, alkaline or lithium AA batteries with 4.8 voltage. The battery unit 404 may also comprise an indicator such as a led that indicates a state of the batteries. The wire 403 and the battery unit 404 may be releasably connected, so that the battery unit 404 can be released from the wire 403, for example, for charging. The wire 403 and the battery unit 404 may be connected to each other by using any suitable connecting elements. For example, the wire 403 may comprise a female contact 406 and the battery unit 404 may comprise a male contact 407 or other way around.

The battery unit 404 is connected to a fastening element 405 acting as fastening means for the battery unit 404. The fastening element 405 may be for example a Velcro Strap that is suitable for releasably mounting the battery unit 404 to user's ankle or calf. It should be noted that the battery unit 404 may be mounted in many possible locations including but not limited to on the shoes or on the target person's lower leg. In addition, it is possible to use other fastening element than Velcro strap. It is possible to mount a stand to the shoe for the battery unit or use fastening screws, press fasteners or any other suitable fastening means for mounting the battery unit to a shoe or lower leg of the target person. It may also be possible that battery unit 404 is an integrated part of a shoe or it is embedded into a shoe.

The battery unit 404 may be released for charging, but it may also be possible to charge the battery unit 404 while it is mounted to target person.

Figure 5:
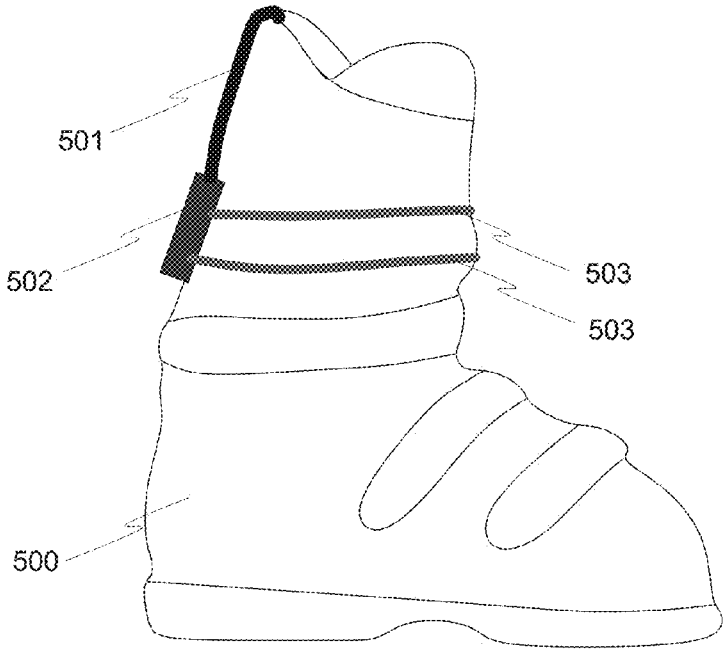
FIG. 5 shows an example of a use a customizable insole with a heating element according to an embodiment of the invention.

FIG. 5 shows an example of a use of a customizable insole with heating element according to an embodiment of the invention. The insole is arranged onto a sole of a slalom boot 500. A wire 501 is guided through the opening of the slalom boot 500 and connected to a battery unit 502. The battery unit 502 is releasably mounted onto the slalom boot 500 by two Velcro straps 503.

Figure 6:
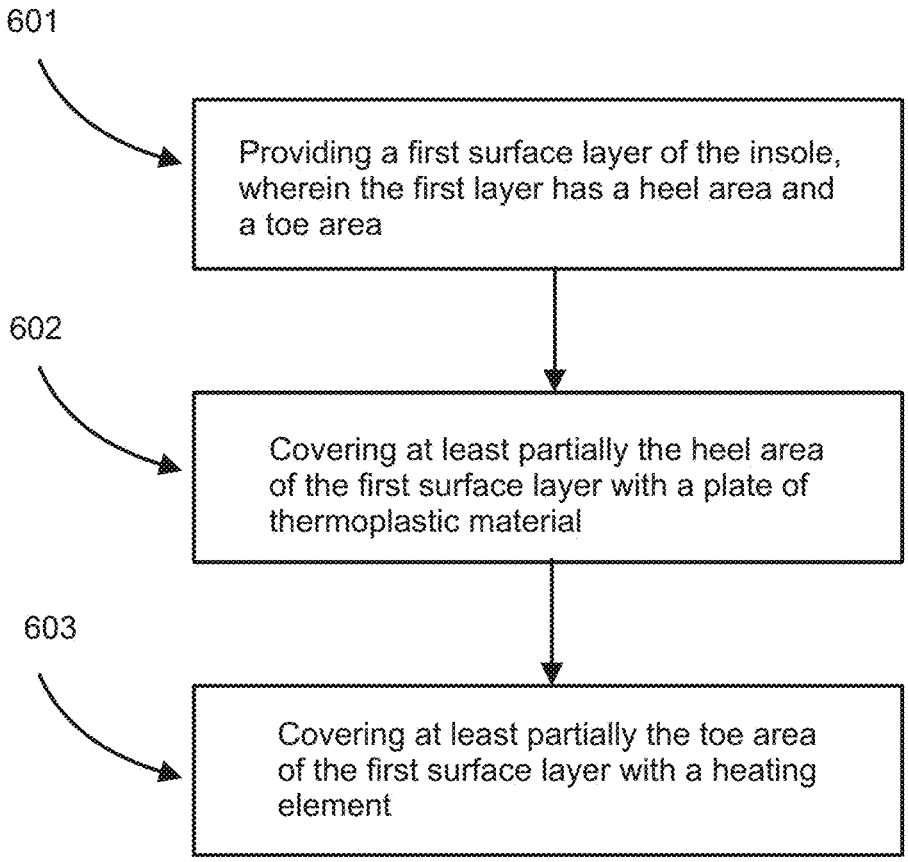
FIG. 6 shows a flowchart of a method for manufacturing a customizable insole with a heating element according to an embodiment of the invention.

FIG. 6 shows a flowchart of a method for manufacturing a customizable insole with heating element according to an embodiment of the invention. In stage 600, a first surface layer of the insole is provided, wherein the first surface layer has a heel area and a toe area. In stage 601, the heel area and of the first surface layer is at least partially covered with a plate of thermoplastic material. In stage 602, the toe area of the first surface layer is at least partially covered with a heating element. The heating element is electrically connected to a wire, wherein the wire is guided on the plate towards the heel area of the first surface layer.

Insoles or soles with at least one layer made of thermoplastic material and heating elements are designed to go into boots and shoes to give individual support for feet and to keep toes and feet warm with soothing, gentle heat even in the coldest of conditions.

It is obvious that the present invention is not limited solely to the above-presented embodiments, but it can be modified within the scope of the appended claims.

The invention claimed is:

1. A heating insole for a shoe, comprising:

a first layer that includes a heel area and a toe area, a plate that covers the heel area, the plate being comprised of a heat-customizable thermoplastic material arranged to be formed, based on an individual user's foot, for personalized support of, at least partially, the heel area, and a battery-operated heating element that covers the toe area and is arranged to at least partially warm at least the toe area, wherein there is a distance, along a length of the first layer, between the plate and the heating element such that the plate and the heating element are non-overlapping.

2. An insole according to claim 1, wherein the thermoplastic material is ABS, PVC, A-PET or PETG.

3. An insole according to claim 1, wherein the heating element is arranged to be electrically connected to a battery unit by a wire for power supply for warming up the heating element.

4. An insole according to claim 1, wherein the insole comprises at least two layers, wherein the first layer is a surface layer and the second layer is formed from the plate and the heating element.

5. An insole according to claim 1, wherein said thermoplastic material becomes plastic substantially under 95° C. and above 45° C. for the heat-customization of the thermoplastic material, based on the individual user's foot, for the personalized support of, at least partially, the heel area.

6. An insole according to claim 1, wherein said thermoplastic material becomes plastic substantially under 95° C. and above 77° C. for the heat-customization of the thermoplastic material, based on the individual user's foot, for the personalized support of, at least partially, the heel area.

7. A shoe comprising a heating sole, comprising:

a heel area and a toe area, a plate of heat-customizable thermoplastic material arranged to be formed, based on an individual user's foot, for personalized support of, at least partially, the heel area, and a battery-operated heating element arranged to at least partially warm at least the toe area, wherein there is a distance between the plate and the heating element such that the plate and the heating element are non-overlapping.

8. A shoe according to claim 7, wherein the thermoplastic material is ABS, PVC, A-PET or PETG.

9. A shoe according to claim 8, wherein the heating element is arranged to be electrically connected to a battery unit by a wire for power supply for warming up the heating element.

10. A shoe according to claim 7, wherein said thermoplastic material becomes plastic substantially under 95° C. and above 45° C. for the heat-customization of the thermoplastic material, based on the individual user's foot, for the personalized support of, at least partially, the heel area.

11. A shoe according to claim 7, wherein said thermoplastic material becomes plastic substantially under 95° C. and above 77° C. for the heat-customization of the thermoplastic material, based on the individual user's foot, for the personalized support of, at least partially, the heel area.

12. A method for manufacturing an insole for a shoe comprising the steps of:

providing a first surface layer of the insole, wherein the first surface layer has a heel area and a toe area;

covering, at least partially, the heel area of the first surface layer with a plate of heat-customizable thermoplastic material arranged to be formed for personalized support of, at least partially, the heel area, and covering, at least partially, the toe area of the first surface layer with a battery operated heating element arranged to at least partially warm at least the toe area, wherein there is a distance between the plate and the heating element such that the plate and the heating element are non-overlapping.

13. A method according to claim 12, wherein the method further comprises:

arranging a wire that is connected to the heating element on the other side of the plate than the first surface such that the wire is guided on the plate from the heating element towards the heel area of the first surface layer.

14. A method according to claim 13, wherein the method further comprises:

covering the first surface layer, the plate, the heating unit and the wire by a second surface layer.

15. A method according to claim 12, wherein the thermoplastic material is ABS, PVC, A-PET or PETG, and wherein the thermoplastic material becomes plastic substantially under 95° C. and above 45° C. for the heat-customization of the thermoplastic material, based on the individual user's foot, for the personalized support of, at least partially, the heel area.

* * * * *